US005761826A

United States Patent [19]

Baur

[11] Patent Number: 5,761,826

[45] Date of Patent: Jun. 9, 1998

[54] DRYING UNIT FOR FILLED, BAND-SHAPED FOIL HOSES

[75] Inventor: Wilhelm Baur, Gestratz, Germany

[73] Assignee: Natec, Reich, Summer GmbH & Co. KG, Germany

[21] Appl. No.: 741,973

[22] Filed: Oct. 31, 1996

[30] Foreign Application Priority Data

Feb. 2, 1996 [DE] Germany ..... 196 03 717.4

[51] Int. Cl.[6] ..... F26B 19/00

[52] U.S. Cl. ..... 34/216; 15/308; 134/64 P

[58] Field of Search ..... 34/59, 60, 85, 34/95, 104, 213, 216; 15/21.1, 97.1, 105, 147.1, 159.1, 308, 309.1, 77; 134/64 P, 122 P

[56] References Cited

U.S. PATENT DOCUMENTS

| | | | |
|---|---|---|---|
| 2,378,418 | 6/1945 | Lister | 34/95 |
| 2,534,205 | 12/1950 | Newhall et al. | 34/95 |
| 3,542,570 | 11/1970 | Bush et al. | 99/178 |
| 4,630,407 | 12/1986 | Rhodes | 51/322 |
| 4,706,325 | 11/1987 | Michelson | 15/308 |
| 5,222,346 | 6/1993 | Wegscheider et al. | 53/440 |
| 5,477,584 | 12/1995 | Thumm | 15/308 |
| 5,568,822 | 10/1996 | Michelson | 134/64 P |

*Primary Examiner*—Henry A. Bennett
*Assistant Examiner*—Steve Gravini
*Attorney, Agent, or Firm*—Brown, Martin, Haller & McClain, LLP

[57] ABSTRACT

Drying unit for filled, band-shaped foil hoses with a filling, shaping, cooling, sealing, drying, and cutting station as well as a stacking and final packaging unit, where the drying station is designed as a cold or warm compressed air drying unit. In the area of the drying unit, the roller brushes are working in opposite directions and the band-shaped foil hose is being guided through the roller gap, which makes the roller brushes run in the opposite direction of the transport direction of the foil hose.

13 Claims, 3 Drawing Sheets

DRYING UNIT FOR FILLED, BAND-SHAPED FOIL HOSES

BACKGROUND OF THE INVENTION

The subject of the presented innovation is a drying unit for filled band-shaped foil hoses.

These types of drying units are being used for the drying of foil hoses filled with a product. For example: during the production of soft cheeses which are being filled into a continuous foil hose in a liquid condition.

According to U.S. Pat. No. 5,222,346 by the same patent Applicant, the foil hose filled with hot cheese substance shaped in a band, will be guided through a cooling process, the cooling liquid - preferably water - should, if possible, be removed from the outside of the band-shaped foil hose. The importance of removing the water is that the water may create a problem during the final phase of the packaging process of the foil packed cheese slices.

As previously known, the foil hose will be pulled out of the cooling substance and transported to a sealing station. After sealing the cross-seams, the hose will be cut at the cross-seam. Thereafter, the cheese slices that have been produced, will be stacked and then transported to a final packaging station.

If there is still water on the outside of the sealed and cut slices during this final packaging process, it will end up in the final package and could result in foul odor or accumulation of mildew.

The second possible interruption is that the accumulated water on the band-shaped foil hose, could interrupt the sealing process which follows, since the sealing clamps could require a higher heat supply and the quality of the seal could suffer.

In the past, to remove the water from this area, the problem was solved by transporting the band-shaped foil hose through a drying station where the hose was exposed to a strong and cold air stream. The disadvantage however, was the high use of air by the drying station and the warming up of the cool foil hose through the air that is directed at it.

The disadvantage of the high use of air causes the disadvantage in high use of energy, because the cool air has to come from the cooling unit in order to prevent the required warm-up of the band-shaped foil hoses after leaving the cooling station.

Another known process uses warm air, which is directed onto the foil hose exiting the cooling station. The disadvantage of this process, is that the foil hose with the cooled down and therefore stable cheese substance, warms up, and the cheese substance inside of the foil hose will become soft again. This process does not assure a maximum quality seal and uses much more power.

Another known process dries these types of foil hoses with only a stripping device made out of rubber, which is positioned at an angle to the transport direction.

SUMMARY OF THE INVENTION

Therefore, the purpose of this innovation is to continue to develop a drying unit of a type as mentioned earlier, which will dry the band-shaped foil hose when leaving the cooling station and which will protect it and use the least amount of energy.

An essential feature of the innovation is that there are brush rollers in the area of the drying unit which are working in opposite directions to each other and the band-shaped foil hose is being guided through their roller gap. This activates the brush rollers and makes them turn in the opposite direction of the transport direction of the foil hose.

According to the innovation, the water remaining on the foil hose is only removed through a brushing-off-effect by the brush rollers working in opposite directions and through the fact that the foil hose is being transported through the roller gap. Therefore, contrary to the latest technical development, not only is the water removed, but the water is being distributed evenly on the outside of the band-shaped foil hose, which brings surprising results.

It has been proven that when an extremely thin film of water remains on the foil hose, that the quality seal of the cross-seams is not effected and that in principal there will be no increase of energy consumption around the sealing clamps. The film of water however, gives the advantage that the formation of the stacks of the individual slices being cut off of the band-shaped foil hose will be considerably improved, since the micro thin film of water forms an adhesive film between the individual slices which evaporates. The slices therefore, stack very snug and close without having the stack slide away.

This way, a superior process of stacking the individual slices is being achieved, which was not possible with the commonly known drying units.

The presented innovation overcomes the pre-judgment of ignoring, as previously known, the complete removal of the film of water, which in one way saves power and on the other hand greatly improves the quality, when stacking the slices.

With the previously known method of air drying, the distribution of the water on the outside of the band-shaped foil hose could not be influenced, which resulted in water drops building up somewhere on the upper or lower side of the foil hose and which then had to be removed through high velocity air streams. This disadvantage is being eliminated with the presented innovation through creating an even and micro-fine film of water on all sides of the band-shaped foil hose.

It does not need to be feared that water may penetrate in the end packaging unit, since the drying process in the stack has already reached a point where the micro fine film of water is hardly present and does not interfere later with the final packaging process.

An additional advantage of the innovated drying unit is that due to the mechanical roller brush action, the water which accumulates in the area of the clip handle of the cheese package, will be removed from the foil through the mechanical fulling, stripping, as well as smoothing action of the brush rollers, without an expensive drying process.

It has proven to be an advantage that the bristles of the brush rollers, which face each other, overlap. This means that the bristles of one roller brush overlap partially with the bristles of the facing roller brush so that they overlap within each other and the band-shaped foil hose moves through the bristle gap. This way the water will be removed through a strong mechanical stripping action from the broadside area of the flat side of the foil hose, while in the area of the small side (small front) the overlapping bristles brush off the small front and remove the film of water from that area.

Through this presented innovation, it is preferred that the drying unit consists of at least two brush rollers facing each other, forming a single bristle gap.

In a future development of this presented innovation it is intended to have two or more of the same brush roller sets which are working in opposite directions and which are positioned one upon the other, successively treat the band-shaped foil hose in the transport direction.

Trademarks of the invented subject matter of the presented innovation do not only apply to the individual trademark, but also to other trademarks pertaining to this project.

All information and features disclosed in these documents, including the summary, and especially the dimensional development depicted in the drawings are considered essential to the invention as far as they are new, individually or as a combination compared to the latest technical developments.

BRIEF DESCRIPTION OF THE DRAWINGS

The following drawings reflect several versions of the invention in detail. The drawings and their description disclose additional features that are unique features and advantages of the new invention.

DESCRIPTION OF THE PREFERRED EMBODIMENT

Figure 1:
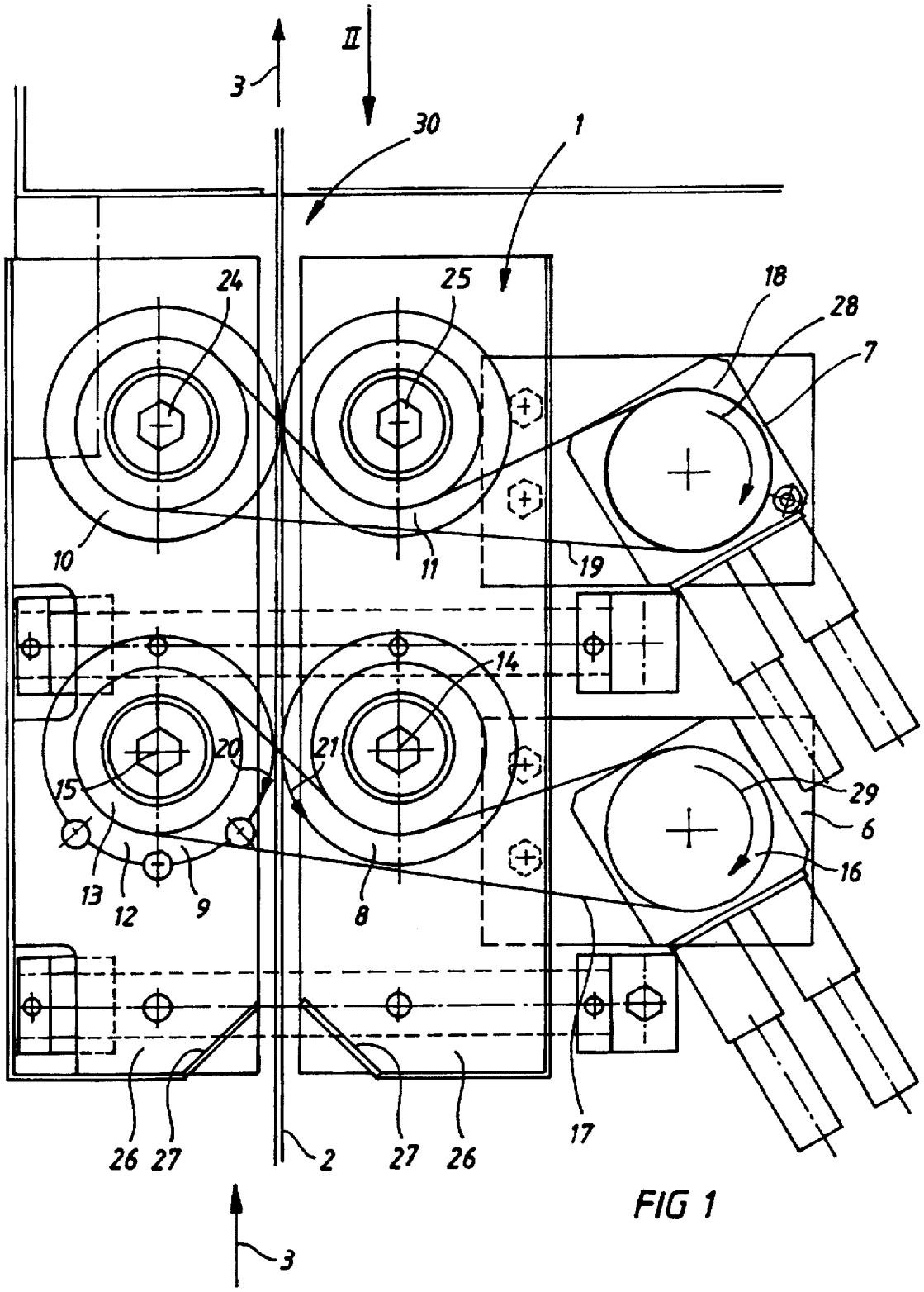
FIG. 1 is a front view of the drying unit, according to the present invention.
Figure 2:
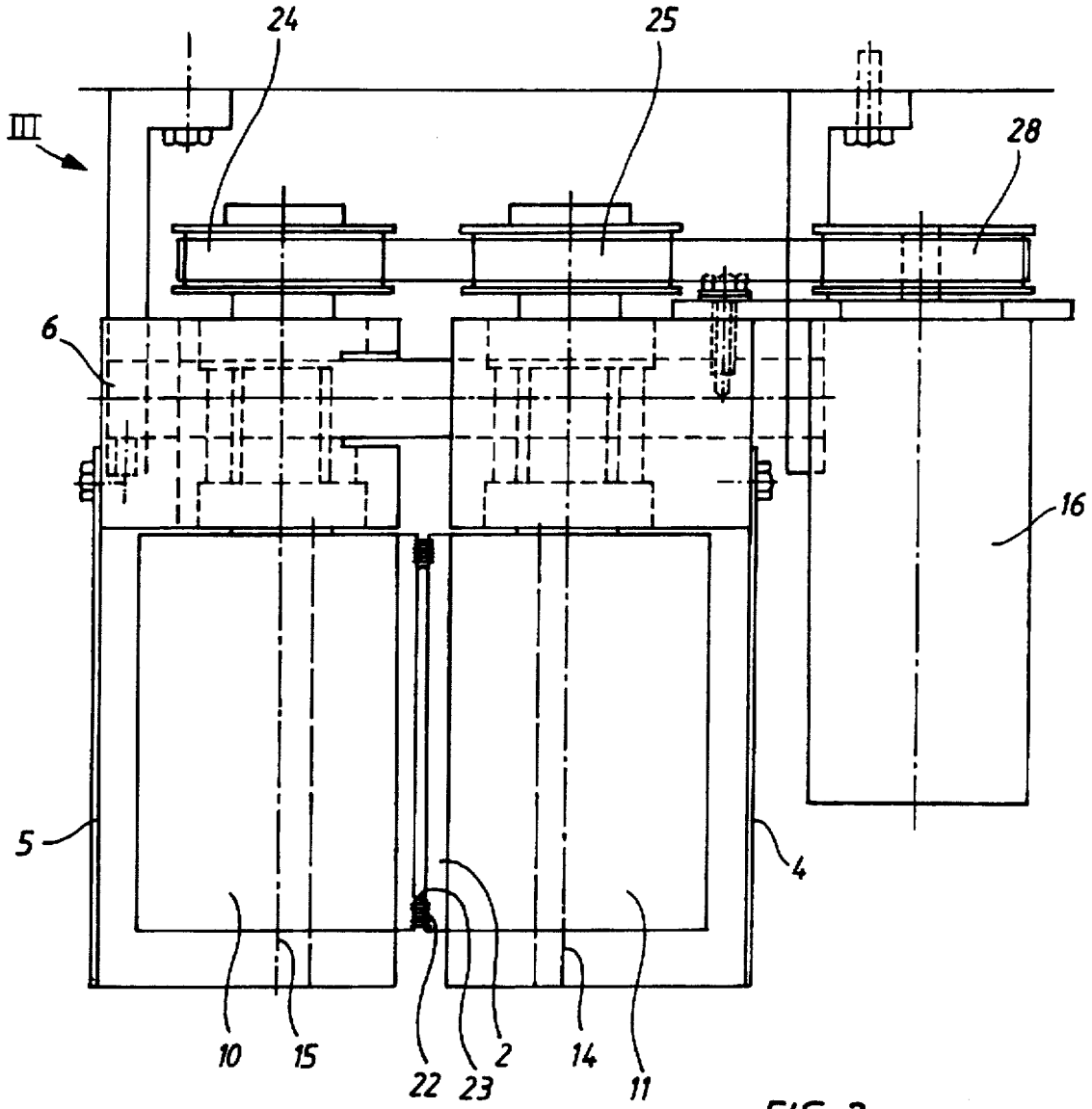
FIG. 2 is a top view in the direction of arrow II, FIG. 1, according to the present invention.
Figure 3:
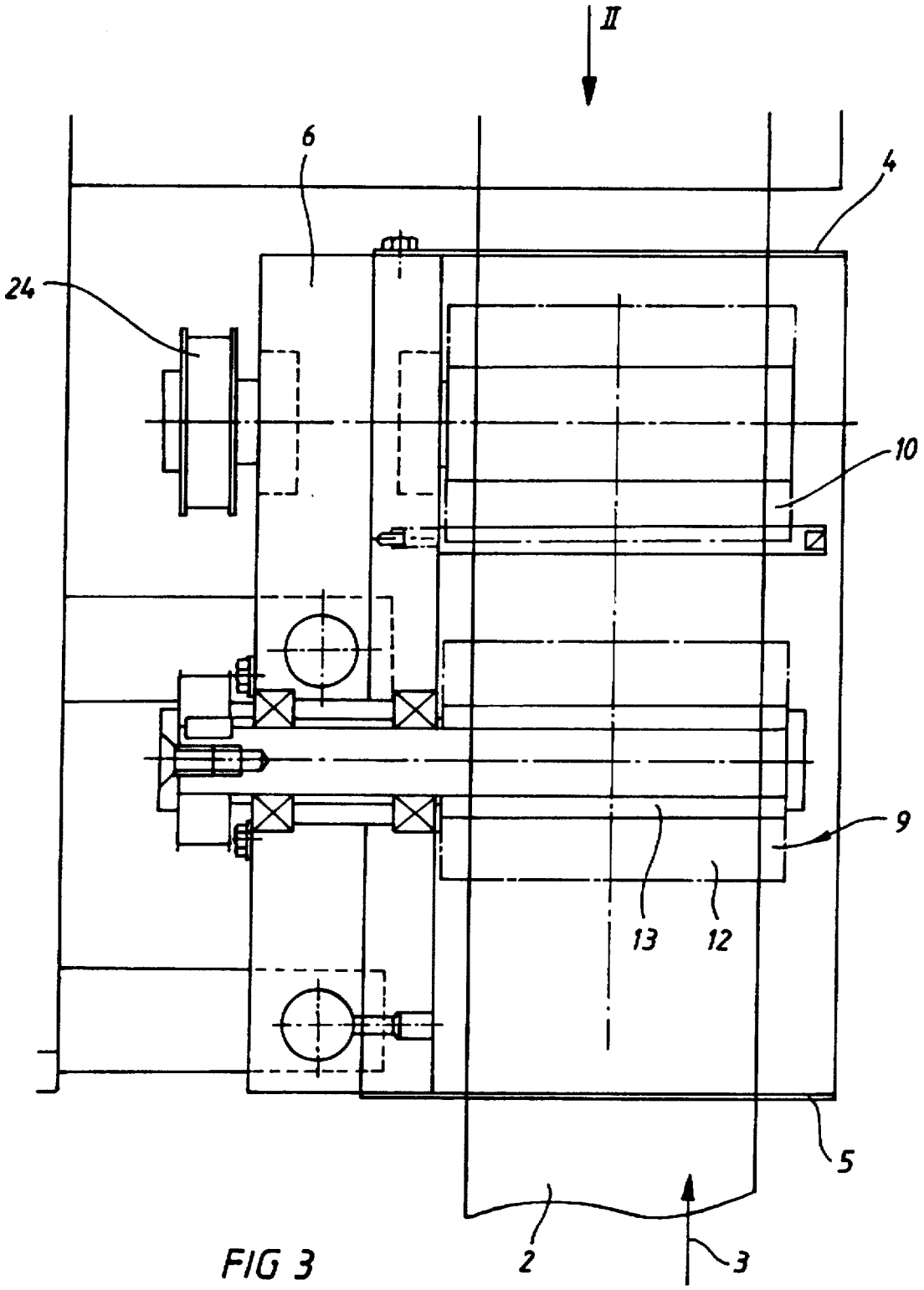
FIG. 3 is the drying unit of the present invention according to FIGS. 1 and 2 in the direction of arrow III, FIG. 2.

The drying unit 1, according to FIGS. 1–3 consists mostly of the housing which has side panels 4,5 running parallel and with some gaps separating them. The housing is open on one side while the other side has bearing blocks 6,7 followed by a drive, mounted to it.

A drive motor 16,18, is installed inside of the bearing block 6,7. Its driving axle with its torsion strength is connected to a coordinating drive wheel 28,29. Each drive wheel 28,29 has a drive belt 17,19, which drives the drive wheels of each set of the brush rollers 8,9,10,11.

Each roller brush has its own drive wheel 24,25, which has its respective drive belt 17,19.

Since the bearing and drive units have the same design, it is sufficient to describe one brush unit, consisting of the brush rollers 8,9, with the bearing block 6, since the other brush rollers 10,11, with bearing block 7 are designed the same way.

As mentioned earlier, only one roller brush unit 8,9 has to be present while the other roller brush unit 10,11 may be dropped.

Each roller brush 8–11, consists of a plastic body 13 which rotates axially and which has a bristle coating 12 with bristles pointing outward.

The bristles of the individual brush rollers 8–11 overlap in the overlap area 22 (FIG. 2). This means that they overlap into one another like fingers.

The band-shaped foil hose 2, which is somewhat shaped in a rectangle, is being pulled upward in direction of arrow 3, through the roller gap of the set of brushes 8,9 and 11,12.

The brush sets 8,9 and 10,11 are driven opposite the transport direction (direction of arrow 3) of the foil hose 2.

According to FIG. 2 the bristle covered 12 individual brush rollers 8–11, brush off the wide side of the foil hose 2, while the front side 23 is being brushed off by the overlapping bristle in the overlap area 22.

A rather simple drive layout makes it possible that the roller brush sets 8,9 and 10,11, are driven by the only drive belt 17,19, which makes them run in the opposite direction of arrow 20,21.

The water building up in the housing, which has been brushed off of the foil hose 2, is running off through the drain area 27 and is saved in a reservoir 26 where it will be discarded to the outside through a drain 30.

FIGS. 1 and 2 show an example where the roller brushes 8,9 inside of the rotational axis 14,15 are located in the bearing block 6 in a way that they can be rotated.

With this drying unit, the surface of the band-shaped foil hose 2 will be entirely coated with a micro-fine film of water right at the outlet 30. This is, as previously described, of benefit during the stacking of the cut foil slices.

The roller brush 8,9,10,11 for example, will be driven with a rotational speed of 1,100 rotations per minute. Due to this high rotational speed the water is being spun off of the bristle coating 12 and is being collected in the reservoir 26.

During this process the foil hose 2 for example, is being pulled through the drying unit 1 at a speed of 70 meters per minute.

The thickness of the foil hose is approximately 2.0 to 4.5 mm, the width for example, may be 84 mm, while the length is practically unlimited, since it is a continuous foil hose. The roller brushes 8–11 are replaceable within the bearing blocks 6,7.

Although a preferred embodiment of the invention has been described above by way of example only, it will be understood by those skilled in the field that modifications may be made to the disclosed embodiment without departing from the scope of the invention, which is defined by the appended claims.

I claim:

1. A drying unit for filled, band-shaped foil hoses, comprising:

a housing defining a transport path for a band-shaped foil hose in a transport direction through the housing;

a pair of brush rollers rotatably mounted in the housing on opposite sides of the transport path to define a roller gap between the rollers, the roller gap lying in the transport path;

each brush roller having outwardly projecting bristles; and a drive assembly for driving the brush rollers to rotate in opposite directions whereby each roller moves in a direction opposite to the transport direction at the roller gap for removing water from a hose passing through the roller gap.

2. The unit as claimed in claim 1, wherein the bristles of the opposing brush rollers overlap and are interdigitated like fingers in the roller gap.

3. The unit as claimed in claim 1 or claim 2, wherein two pairs of brush rollers are arranged at spaced intervals in the transport path, each pair of brush rollers defining a roller gap in the transport path.

4. The unit as claimed in claim 1, wherein the housing has a pair of spaced, parallel side panels and is open at a first side of the side panels and closed at a second side of the side panels, and two bearing blocks are mounted at the closed side of the side panels, the drive assembly being mounted to the bearing blocks.

5. The unit as claimed in claim 4, wherein the drive assembly comprises a drive motor installed inside the bearing blocks, the drive motor having a driving axle, at least one driving wheel connected to the driving axle, each brush roller having a drive wheel, and a drive belt extending around the driving wheel and both roller drive wheels for driving the brush rollers.

6. The drying unit as claimed in claim 1, wherein each brush roller comprises an axially rotating plastic body having an outer surface, the outer surface having a bristle coating with bristles pointing outwardly from said body.

7. The drying unit as claimed in claim 1, wherein the housing is oriented with the transport direction extending upwards, the band-shaped foil hose having a substantially rectangular cross-section, and the brush rollers each rotating downwardly opposite to the transport direction at the roller gap through which the hose travels.

8. The drying unit as claimed in claim 2, wherein each brush roller has an outer surface covered with bristles, and the width of the bristle covered surface is greater than the width of the band-shaped foil hose, whereby opposite outer surfaces of the hose are brushed off by the respective roller brushes and opposite side edges of the hose are brushed off by the overlapping, interdigitating bristles on each side of the hose in the roller gap.

9. The drying unit as claimed in claim 1, wherein one of the brush rollers is driven in a clockwise direction and the other brush roller is driven in an anti-clockwise direction.

10. The drying unit as claimed in claim 1, wherein the housing has a drain area for directing water running off the foil hose out of the housing and into a reservoir.

11. The drying unit as claimed in claim 1, wherein the ratio of the speed of the band-shaped foil hose and the speed of the brush rollers is 1:4.5.

12. The drying unit as claimed in claim 1, wherein the speed of the foil hose is approximately 70 meters per minute, the thickness of the hose is approximately 2.0 to 4.5 mm., and the width of the hose is approximately 84 mm.

13. The drying unit as claimed in claim 4, wherein the brush rollers are replaceable within the bearing blocks.

* * * * *